US008524648B2

(12) United States Patent
Warkotsch et al.

(10) Patent No.: US 8,524,648 B2
(45) **Date of Patent: *Sep. 3, 2013**

(54) COLOR-PROTECTING DETERGENTS OR CLEANING AGENTS

(75) Inventors: Nadine Warkotsch, Duesseldorf (DE); Birgit Middelhauve, Monheim (DE); Marc-Steffen Schiedel, Duesseldorf (DE); Thomas Eiting, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 188 days.

This patent is subject to a terminal disclaimer.

(21) Appl. No.: 12/566,945

(22) Filed: Sep. 25, 2009

(65) Prior Publication Data

US 2010/0011519 A1 Jan. 21, 2010

Related U.S. Application Data

(63) Continuation of application No. PCT/EP2008/053995, filed on Apr. 3, 2008.

(30) Foreign Application Priority Data

| | | |
|---|---|---|
| Apr. 3, 2007 | (DE) | 10 2007 016 391 |
| May 21, 2007 | (DE) | 10 2007 023 828 |
| Aug. 14, 2007 | (DE) | 10 2007 038 450 |

(51) Int. Cl.

| | |
|---|---|
| ***C11D 1/00*** | (2006.01) |
| ***C11D 3/20*** | (2006.01) |
| ***C11D 3/37*** | (2006.01) |

(52) U.S. Cl.

USPC ..... 510/466; 510/336; 510/337; 510/356; 510/357; 510/475; 510/499; 510/500; 510/505; 8/137

(58) Field of Classification Search

USPC ..... 510/336, 337, 356, 357, 466, 475, 510/499, 500; 8/137

See application file for complete search history.

(56) References Cited

U.S. PATENT DOCUMENTS

| | | | | |
|---|---|---|---|---|
| 3,367,920 | A | 2/1968 | Wasserman et al. | |
| 3,893,929 | A | 7/1975 | Basadur | |
| 4,000,093 | A | 12/1976 | Nicol et al. | |
| 4,116,885 | A | 9/1978 | Derstadt et al. | |
| 4,136,038 | A | 1/1979 | Pracht et al. | |
| 4,174,305 | A | 11/1979 | Burns et al. | |
| 4,201,824 | A | 5/1980 | Violland et al. | |
| 4,664,839 | A | 5/1987 | Rieck | |
| 5,534,182 | A | 7/1996 | Kirk et al. | |
| 5,622,926 | A | 4/1997 | Schade et al. | |
| 5,643,581 | A | 7/1997 | Mougin | |
| 6,395,265 | B1 | 5/2002 | Mougin | |
| 8,044,011 | B2 * | 10/2011 | Warkotsch et al. | 510/222 |
| 8,044,016 | B2 * | 10/2011 | Warkotsch et al. | 510/427 |
| 2003/0158064 | A1 | 8/2003 | Kessler et al. | |
| 2003/0198819 | A1 | 10/2003 | Reusmann | |
| 2004/0034911 | A1 | 2/2004 | Day | |
| 2007/0092656 | A1 | 4/2007 | Keul | |
| 2008/0075683 | A1 | 3/2008 | Herzig | |
| 2009/0232752 | A1 | 9/2009 | Carson | |
| 2010/0011513 | A1 | 1/2010 | Warkotsch et al. | |
| 2010/0016203 | A1 | 1/2010 | Warkotsch et al. | |
| 2010/0016206 | A1 | 1/2010 | Warkotsch et al. | |
| 2010/0022427 | A1 | 1/2010 | Warkotsch et al. | |
| 2010/0022428 | A1 | 1/2010 | Warkotsch et al. | |
| 2010/0028270 | A1 | 2/2010 | Nguyen-Kim | |

FOREIGN PATENT DOCUMENTS

| | | | |
|---|---|---|---|
| DE | 1617141 | A1 | 10/1965 |
| DE | 2200911 | A1 | 1/1971 |
| DE | 2253063 | A1 | 10/1971 |
| DE | 2412837 | | 10/1974 |
| DE | 2655551 | A1 | 6/1977 |
| DE | 2846984 | A1 | 5/1979 |
| DE | 2857292 | A1 | 2/1980 |
| DE | 3324258 | A1 | 1/1984 |
| DE | 42 44 386 | A1 | 6/1994 |
| DE | 10037126 | A1 | 2/2002 |
| DE | 100 50 622 | A1 | 5/2002 |
| DE | 103 57 232 | B3 | 6/2005 |
| EP | 0164514 | A1 | 11/1984 |
| EP | 0 185 427 | | 6/1986 |
| EP | 0 213 739 | A2 | 3/1987 |
| EP | 0 300 305 | A2 | 7/1987 |
| EP | 0 241 984 | A2 | 10/1987 |
| EP | 0 241 985 | A2 | 10/1987 |
| EP | 0 213 729 | | 11/1987 |
| EP | 0 213 730 | | 11/1987 |
| EP | 2 53 567 | A1 | 1/1988 |
| EP | 0 271 312 | A2 | 6/1988 |
| EP | 2 72 033 | A2 | 6/1988 |
| EP | 0 274 907 | A1 | 7/1988 |
| EP | 357280 | A2 | 3/1990 |
| EP | 0 634 486 | A1 | 1/1995 |
| EP | 1 541 568 | A1 | 6/2005 |
| GB | 1154730 | | 6/1969 |
| GB | 1377092 | | 12/1974 |
| GB | 2007692 | A | 5/1979 |
| GB | 1578930 | | 11/1980 |
| GB | 2165856 | | 4/1986 |
| WO | WO-97/09369 | A | 3/1997 |
| WO | WO 99/41347 | | 8/1999 |
| WO | WO 00/77138 | A1 | 12/2000 |
| WO | WO 03/035712 | A1 | 5/2003 |
| WO | WO 03/042264 | A2 | 5/2003 |
| WO | WO 03/095530 | A1 | 11/2003 |
| WO | WO 2005/042684 | A1 | 5/2005 |
| WO | WO 2005/058863 | A1 | 6/2005 |
| WO | WO2005121218 | * | 12/2005 |
| WO | WO 2006/005358 | A1 | 1/2006 |
| WO | WO 2006/029794 | A1 | 3/2006 |
| WO | WO2006/069742 | * | 7/2006 |
| WO | WO 2006/069742 | A1 | 7/2006 |
| WO | WO 2006/127882 | A2 | 11/2006 |

* cited by examiner

OTHER PUBLICATIONS

International Search Report for Priority Application PCT/EP2008/053995, (Jul. 2008).

*Primary Examiner* — Gregory Delcotto

(74) *Attorney, Agent, or Firm* — RatnerPrestia

(57) ABSTRACT

The invention provides improvements in the color protection properties of detergents and cleaning agents during their utilization for washing or cleaning colored textile fabrics. Specific polycarbonate-, polyurethane- and/or polyurea-polyorganosiloxane compounds or a precursor compound thereof containing specific reactive groups, which can be used for the production of the polycarbonate-, polyurethane- and/or polyurea-polyorganosiloxane compounds, are utilized.

8 Claims, No Drawings

COLOR-PROTECTING DETERGENTS OR CLEANING AGENTS

CROSS-REFERENCE TO RELATED APPLICATIONS

This application is a continuation under 35 U.S.C. §§120 and 365(c) of International Application PCT/EP2008/053995, filed on Apr. 3, 2008, and published as WO 2008/119832 on Oct. 9, 2008. This application also claims priority under 35 U.S.C. §119 of DE 10 2007016391.8 filed Apr. 3, 2007, DE 10 2007023828.4, filed May 21, 2007, and DE 10 2007038450.7, filed Aug. 14, 2007. The disclosures of PCT/EP2008/053995, DE 10 2007016391.8, DE 10 2007023828.4, and DE 10 2007038450.7 are hereby incorporated by reference in their entirety for all purposes.

FIELD OF THE INVENTION

The present invention relates to the use of polycarbonate-, polyurethane- and/or polyurea-polyorganosiloxane compounds or precursor compounds that may be used in their synthesis, having certain reactive groups as dye transfer inhibiting active ingredients in washing and/or cleaning textiles, and detergents or cleaning agents which contain such compounds.

DISCUSSION OF THE RELATED ART

In addition to the ingredients such as surfactants and builder materials, which are indispensable for the washing or cleaning process, detergents and cleaning agents usually contain other ingredients which can be subsumed under the term "wash aids" and include the different groups of active ingredients such as foam regulators, anti-grey compounds, bleaching agents, bleach activators and enzymes. Such auxiliary substances also include substances which should prevent dyed textile fabrics from giving an altered color impression after being washed. This change in color impression of washed, i.e. clean, textiles can be based, firstly, on the fact that the dye components are removed from the textile by the washing or cleaning process ("fading") and, secondly, dyes released from textiles of other colors may be deposited on the textile ("discoloration"). The discoloration aspect may also play a role with undyed items of laundry if they are washed together with colored laundry items. To prevent these unwanted secondary effects of the removal of dirt from textiles by treating them with aqueous systems, usually containing a surfactant, detergents contain active ingredients, which prevent dyes from being released from the textile or which should at least prevent the deposition of dissolved dyes in the wash bath onto textiles, in particular when they are provided as so-called colored laundry detergents for washing colored textiles. However, many of the polymers typically used have such a high affinity for dyes that they absorb them to an increased extent from the dyed fibers, and thus color losses occur when they are used.

BRIEF SUMMARY OF THE INVENTION

It has now surprisingly been found that certain polycarbonate-, polyurethane- and/or polyurea-polyorganosiloxane compounds, but also precursor compounds of the reactive cyclic carbonate and urea type that can be used in their synthesis, lead to unexpectedly high dye transfer inhibition when used in detergents. Prevention of the staining of white or other colored textiles by dyes washed out of textiles is especially pronounced. It is conceivable that the compounds defined in greater detail below are absorbed onto the textile in washing and thus effectively prevent the release of dyes from the textiles and also have a repellent effect on dye molecules already in the washing liquid.

DETAILED DESCRIPTION OF CERTAIN EMBODIMENTS OF THE INVENTION

The subject of the invention is the use of polycarbonate-, polyurethane- and/or polyurea-polyorganosiloxane compounds, comprising at least one structural element of Formula (I):

$$—Y-A-(C{=}O)-A- \quad (I)$$

where each A is selected, independently, from S, O and $NR^1$,

Y is selected from divalent to polyvalent, in particular tetravalent, linear, cyclic or branched, saturated, unsaturated or aromatic, substituted or unsubstituted hydrocarbon radicals with up to 1000 carbon atoms (not counting the carbon atoms of a polyorganosiloxane unit that is optionally also included), which may contain one or more groups selected from —O—, —(CO)—, —NH—, —$NR^2$—, —($N^+R^2R^3$)— and a polyorganosiloxane unit with 2 to 1000 silicon atoms, $R^1$ is hydrogen or a linear, cyclic or branched, saturated, unsaturated or aromatic hydrocarbon radical with up to 40 carbon atoms, which may contain one or more groups selected from —O—, —(CO)—, —NH— and —$NR^2$—, $R^2$ is a linear, cyclic or branched, saturated, unsaturated or aromatic hydrocarbon radical with up to 40 carbon atoms, which may contain one or more groups selected from —O—, —(CO)— and —NH—, $R^3$ is a linear, cyclic or branched, saturated, unsaturated or aromatic hydrocarbon radical with up to 100 carbon atoms, which may contain one or more groups selected from —O—, —(CO)— and —NH— or is a divalent radical, which forms cyclic structures within the radical Y, or one or both radicals A vicinal to Y together with the radical Y between them may form a heterocyclic radical containing nitrogen, and in the entire compound, not all the radicals A and/or Y and/or $R^1$ and/or $R^2$ and/or $R^3$ indicated in Formula (I) must be the same, with the provision that at least one of the radicals Y in the entire compound is a polyorganosiloxane unit with 2 to 1000 silicon atoms or the acid addition compounds and/or salts thereof, to prevent the transfer of textile dyes from dyed textiles to undyed textiles or those of a different color when they are washed together in aqueous solutions containing a surfactant in particular.

Compounds of general Formula (I) can be obtained by reacting diisocyanates, bischloroformic acid esters and/or amides or phosgene with thiols, alcohols or amines containing the structural element Y. To obtain polymer structures, these starting compounds containing the structural element Y have at least two of the aforementioned functional groups. Compounds that are monofunctional but otherwise correspond to structural element Y may be considered as end groups.

Of preferred polycarbonate- and/or polyurethane-polyorganosiloxane compounds, there are those containing at least one structural element of Formula (II) or (III):

$$\text{-A-Y-A-(CO)—O—Z—(CHOH)—Z—O—(CO)—} \quad \text{(II)}$$

$$\text{-A-Y-A-(CO)—O—(CHCH}_2\text{OH)—Z—O—(CO)—} \quad \text{(III)}$$

in which A and Y have the meanings given above, and Z is selected from the divalent, linear, cyclic or branched, saturated or unsaturated, optionally substituted hydrocarbon radicals with 1 to 12 carbon atoms. These structural elements can be obtained by ring opening of cyclic carbonates (carbonic acid esters of vicinal diols) with thiols, alcohols or amines containing the structural element Y.

The polycarbonate-, polyurethane- and/or polyurea-polyorganosiloxane compound preferably contains the structural element of Formula (I) several times in series, where the corresponding radicals A and/or Y and/or Z and/or $R^1$ and/or $R^2$ and/or $R^3$, which occur multiple times, may be the same or different.

The term "acid addition compound" denotes a salt-like compound, which can be obtained by protonation of basic groups in the molecule, in particular the amino groups that are optionally present, e.g. by reaction with organic or inorganic acids. The acid addition compounds may be used as such or may optionally be formed under the conditions of use of the compounds defined above.

If the polycarbonate-, polyurethane- and polyurea-polyorganosiloxane compound contains $—(N^+R^2R^3)—$ groups, then conventional counter anions, e.g. halide, hydroxide, sulfate, carbonate, are present in an amount sufficient to ensure charge neutrality.

The polyorganosiloxane structural element present in the polycarbonate-, polyurethane- and/or polyurea-polyorganosiloxane compounds is preferably the structure $—(SiR^4{}_2O)_p—(SiR^4{}_2)—$, where $R^4$ is a linear, cyclic or branched, saturated, unsaturated or aromatic hydrocarbon radical with up to 20 carbon atoms, and p=1 to 999. The polycarbonate-, polyurethane- and polyurea-polyorganosiloxane compounds preferably contain on the average at least two, in particular at least three of the aforementioned polyorganosiloxane structural elements. $R^4$ is preferably a linear or cyclic or branched, saturated or unsaturated or aromatic $C_1$ to $C_{20}$, in particular a $C_1$ to $C_9$ hydrocarbon radical, especially preferably methyl or phenyl, and p is in particular 1 to 199, especially preferably 1 to 99. In a preferred embodiment, all radicals $R^4$ are the same.

Preferred polycarbonate-, polyurethane- and/or polyurea-polyorganosiloxane compounds used according to the invention are linear, i.e. all Y units in the structural element of Formula (I) are divalent radicals. However, branched compounds may also be covered by the present invention, in which at least one of the radicals Y is trivalent or polyvalent, preferably tetravalent, so that branched structures with linear repeating structures are formed from structural elements of Formula (I).

In another embodiment, at least one of the Y units according to the structural element of Formula (I) has a group $—NR^2—$ and at least one of the Y units according to the structural element of Formula (I) has a group $—(N^+R^2R^3)—$ in the polycarbonate-, polyurethane- and/or polyurea-polyorganosiloxane compound used according to the invention. $R^2$ and $R^3$ here are preferably methyl groups.

Another embodiment relates to the multiple regular occurrences of —O— groups in at least one of the units Y, $R^1$, $R^2$ and/or $R^3$ according to the structural element of Formula (I), preferably in the form of oligoethoxy groups and/or oligopropoxy groups, whereby their degrees of oligomerization are preferably in the range from 2 to 60.

In another preferred embodiment, oligoethyleneimine groups whose degrees of oligomerization are in the range of 10 to 150,000 are present in at least one of the units Y, $R^1$, $R^2$ and/or $R^3$ according to the structural element of Formula (I).

Reactive cyclic carbonates and ureas, processes for synthesis of same and reaction of same with polymer substrates are described in International Patent Application WO 2005/058863. It has now surprisingly been found that not only do the polycarbonate- and/or polyurethane-polyorganosiloxane compounds of the type indicated above, which are accessible from same, improve the adhesion of scents to surfaces, but also the reactive cyclic carbonates and ureas themselves and/or the polymers obtainable from same by reaction with polymer substrates have the desired effect.

Another subject of the invention is therefore the use of compounds of the general Formula (IV) or (V):

IV

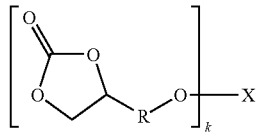

V

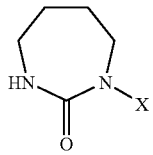

in which

R stands for $C_1$-$C_{12}$ alkylene k stands for a number greater than 0,

X stands for CO—CH═$CH_2$, CO—C($CH_3$)═$CH_2$, CO—O-aryl, $C_2$-$C_6$-alkylene-$SO_2$—CH═$CH_2$ or CO—NH—$R^1$; and $R^1$ stands for $C_1$-$C_{30}$-alkyl, $C_1$-$C_{30}$-haloalkyl, $C_1$-$C_{30}$-hydroxyalkyl, $C_1$-$C_6$-alkyloxy-$C_1$-$C_{30}$-alkyl, $C_1$-$C_6$-alkylcarbonyloxy-$C_1$-$C_{30}$-alkyl, amino-$C_1$-$C_{30}$-alkyl, mono- or di($C_1$-$C_6$-alkyl)amino-$C_1$-$C_{30}$-alkyl, ammonio-$C_1$-$C_{30}$-alkyl, polyoxyalkylene-$C_1$-$C_{30}$-alkyl, polysiloxanyl-$C_1$-$C_{30}$-alkyl, (meth)-acryloyloxy-$C_1$-$C_{30}$-alkyl, sulfono-$C_1$-$C_{30}$-alkyl, phosphono-$C_1$-$C_{30}$-alkyl, di($C_1$-$C_6$-alkyl)phosphono-$C_1$-$C_{30}$-alkyl, phosphonato-$C_1$-$C_{30}$-alkyl, di($C_1$-$C_6$-alkyl)-phosphonato-$C_1$-$C_{30}$-alkyl or a saccharide radical, such that X in Formula (IV) has this meaning only when k stands for 1, or X stands for (i) the radical of a polyamine to which the part of the formula in parentheses is bound via (CO)NH groups, or (ii) a polymer structure to which the part of the formula in parentheses is bound via (CO), NH—$C_2$-$C_6$-alkylene-O(CO) or (CO)—O—$C_2$-$C_6$-alkylene-O(CO) groups, or (iii) a polymer structure to which the part of the formula in parentheses is bound via (CO)-polysiloxanyl-$C_1$-$C_{30}$-alkyl groups, when k stands for a number greater than 1, and/or contains polymers which are obtainable by reaction of a polymer substrate having functional groups, which are selected from hydroxyl groups, primary and secondary amino groups, with a compound of Formula (IV) or (V).

The polymer substrates suitable in conjunction with the aspect of the invention mentioned last include in particular polyvinyl alcohols, polyalkyleneamines, such as polyethyleneimines, polyvinylamines, polyallyl-amines, polyethylene glycols, chitosan, polyamide-epichlorohydrin resins, polyaminostyrenes, polysiloxanes substituted with aminoalkyl groups in terminal position or as side groups, e.g. polydimethylsiloxanes, peptides, polypeptides and proteins as well as mixtures thereof. Especially preferred substrates are selected from polyethyleneimines with molecular weights in the range of 5000 to 100,000 in particular 15,000 to 50,000, compounds of formula $NH_2$—$[CH_2]_m$—$(Si(CH_3)_2O)_n$—$Si(CH_3)_2$—$[CH_2]_o$—R', where m=1 to 10, preferably 1 to 5, especially preferably 1 to 3, where n=1 to 50, preferably 30 to 50, where o=0 to 10, preferably 1 to 5, especially preferably 1 to 3, and where R'=H, $C_{1-22}$ alkyl, an amino group or an ammonium group, and/or compounds of formula $NH_2$—$[CH(CH_3)$—$CH_2O]_l$—$[CH_2$—$CH_2O]_m$—$[CH_2$—$CH(CH_3)O]_n$—R", where l, m and n, independently of one another, denote numbers from 0 to 50, with the provision that the sum l+m+n=5 to 100, in particular 10 to 50, preferably 10 to 30, especially preferably 10 to 20, and R"=H, a $C_{1-22}$ alkyl, $C_{1-22}$ aminoalkyl or $C_{1-22}$ ammonium alkyl group and mixtures thereof.

Of the polymers, those that are especially preferred are obtainable by reaction of the polymer substrate with a compound of Formula (IV), where k=1, or of Formula (V). Also preferred are polymers obtainable by reaction of the polymer substrate with the same molar amounts of the compound of Formula (IV), where k=1, or of Formula (V), based on the amount of hydroxyl groups, primary and secondary amino groups.

The compound of Formula (IV) is preferably selected from
4-phenyloxycarbonyloxymethyl-2-oxo-1,3-dioxolane,
4-(4-phenyloxycarbonyloxy)butyl-2-oxo-1,3-dioxolane,
2-oxo-1,3-dioxolan-4-yl-methyl acrylate,
2-oxo-1,3-dioxolan-4-yl-methyl methacrylate,
4-(2-oxo-1,3-dioxolan-4-yl)butyl acrylate,
4-(2-oxo-1,3-dioxolan-4-yl)butyl methacrylate and
4-(vinylsulfonylethyloxy)butyl-2-oxo-1,3-dioxolane.

The desired dye transfer inhibitor effect also occurs when the active ingredients described here (the polycarbonate-, polyurethane- and/or polyurea-polyorganosiloxane compound, the reactive cyclic carbonate or the reactive cyclic urea and/or the polymer obtainable from the latter by reaction with a polymer substrate) are brought in contact with the textile in a laundry aftertreatment step, e.g. as a component of a fabric softener, and the textile treated in this way is washed in the next washing operation, which can be performed with an agent containing the active ingredient used according to the invention or an agent that is free of this active ingredient, in the presence of laundry items of different colors.

Another subject of the invention is therefore a color-protecting detergent, cleaning agent or laundry aftertreatment agent containing a dye transfer inhibitor in the form of an active ingredient defined above in addition to conventional ingredients that are compatible with this component.

An inventive agent preferably contains 0.01 wt % to 5 wt %, in particular 0.1 wt % to 1 wt % of the aforementioned agent. The joint use of compounds, which correspond to one of the aforementioned classes of compounds is also possible.

The active ingredients mentioned make a contribution to color constancy with the two aspects mentioned above, namely they reduce discoloration as well as fading, even when the effect of preventing staining, in particular when washing white textiles, is the most pronounced. Therefore, another subject of the invention is the use of a corresponding active ingredient to prevent a change in the color impression of textiles when they are laundered in aqueous solutions containing a surfactant in particular. The change in color impression is by no means to be understood as the difference between a soiled textile and a clean textile, but instead the color difference between a clean textile before and after the washing operation.

Another subject of the invention is a method for washing colored textiles in aqueous solutions containing a surfactant, this method being characterized in that an aqueous solution containing a surfactant and an active ingredient as defined above is used. In such a method, it is also possible to wash white or undyed textiles together with dyed textiles without staining the white or undyed textile.

In addition to said dye transfer inhibiting active ingredient, an inventive agent may, if desired, additionally contain a known dye transfer inhibitor, preferably in amounts of 0.01 wt % to 5 wt %, in particular 0.1 wt %. In a preferred embodiment of the invention, the dye transfer inhibitor is a polymer of vinylpyrrolidone, vinylimidazole, vinylpyridine N-oxide or a copolymer thereof. Both polyvinylpyrrolidones with molecular weights of 15,000 to 50,000 and polyvinylpyrrolidones with molecular weights of more than 1,000,000, in particular 1,500,000 to 4,000,000, N-vinylimidazole/N-vinylpyrrolidone copolymers, polyvinyloxazolidones, copolymers based on vinyl monomers and carboxylic acid amides, polyesters and polyamides containing pyrrolidone groups, grafted polyamidoamines and polyethyleneimines, polymers with amide groups from secondary amines, polyamine N-oxide polymers, polyvinyl alcohols and copolymers based on acrylamidoalkenylsulfonic acids may also be used. However, it is also possible to use enzymatic systems comprising a peroxidase and hydrogen peroxide and/or a substance that supplies hydrogen peroxide in water. Addition of a mediator compound for the peroxidase, e.g. an acetosyringone, a phenol derivative or a phenothiazine or phenoxazine is preferred in this case, and the aforementioned polymer dye transfer inhibitor active ingredients may also be used. Polyvinylpyrrolidone preferably has an average molecular weight in the range of 10,000 to 60,000, in particular in the range of 25,000 to 50,000, for use in the inventive agents. Of the copolymers, those of vinylpyrrolidone and vinylimidazole in a molar ratio of 5:1 to 1:1 with an average molecular weight in the range of 5000 to 50,000 in particular 10,000 to 20,000 are preferred.

The inventive detergents, which may be present in particular as powdered solids, in post-compacted particulate form, as homogeneous solutions or suspensions may in principle contain any known ingredients that are conventionally used in such agents in addition to the active ingredient used according to the present invention. The inventive agents may contain in particular builder substances, surfactants, bleaching agents based on organic or inorganic peroxygen compounds, bleach activators, water-miscible organic solvents, enzymes, sequestering agents, electrolytes, pH regulators and other auxiliary substances such as optical brighteners, anti-grey compounds, foam regulators as well as dyes and scents.

The inventive agents may contain one or more surfactants, in particular anionic surfactants, nonionic surfactants and mixtures thereof as well as cationic, zwitterionic and amphoteric surfactants.

Suitable nonionic surfactants include in particular alkyl glycosides and ethoxylation products and/or propoxylation products of alkyl glycosides or linear or branched alcohols, each with 12 to 18 carbon atoms in the alkyl part and 3 to 20, preferably 4 to 10 alkyl ether groups. In addition, corresponding ethoxylation or propoxylation products of N-alkylamines, vicinal diols, fatty acid esters and fatty acid amides, which correspond to the aforementioned long-chain alcohol derivatives with regard to the alkyl part, as well as such products of alkyl phenols with 5 to 12 carbon atoms in the alkyl radical may also be used.

The nonionic surfactants used are preferably alkoxylated, advantageously ethoxylated, in particular primary alcohols, preferably with 8 to 18 carbon atoms and an average of 1 to 12 mol ethylene oxide (EO) per mol alcohol, in which the alcohol radical may be linear or preferably has methyl branching in position 2 and/or may contain linear and methyl-branched radicals in mixture, such as those usually found in oxo alcohol radicals. In particular, however, alcohol ethoxylates with linear radicals of alcohols of native origin with 12 to 18 carbon atoms, e.g., from coconut, palm, tallow fatty alcohol or oleyl alcohol and an average of 2 to 8 EO per mol alcohol are preferred. The preferred ethoxylated alcohols include, for example, $C_{12}$-$C_{14}$ alcohols with 3 EO or 4 EO, $C_9$-$C_{11}$ alcohols with 7 EO, $C_{13}$-$C_{15}$ alcohols with 3 EO, 5 EO, 7 EO or 8 EO, $C_{12}$-$C_{18}$ alcohols with 3 EO, 5 EO or 7 EO and mixtures thereof, e.g. mixtures of $C_{12}$-$C_{14}$ alcohol with 3 EO and $C_{12}$-$C_{18}$ alcohol with 7 EO. The stated degrees of ethoxylation are statistical averages, which may be an integer or a fraction for a specific product. Preferred alcohol ethoxylates have a narrow homolog distribution (narrow range ethoxylates, NRE). In addition to these nonionic surfactants, fatty alcohols with more than 12 EO may also be used. Examples of these include (tallow) fatty alcohols with 14 EO, 16 EO, 20 EO, 25 EO, 30 EO or 40 EO. Extremely low-sudsing compounds are usually used especially in agents for use in machine washing methods. These include, for example, $C_{12}$-$C_{18}$ alkylpolyethylene glycol-polypropylene glycol ethers with up to 8 mol ethylene oxide or propylene oxide units in the molecule. However, other known low-sudsing nonionic surfactants may also be used, e.g., $C_{12}$-$C_{18}$ alkylpolyethylene glycol-polybutylene glycol ethers, each with up to 8 mol ethylene oxide and butylene oxide units in the molecule and end-group-capped alkylpolyalkylene glycol mixed ethers. The alkoxylated alcohols that contain hydroxyl groups, such as those described in European Patent Application EP 0 300 305, so-called hydroxy mixed ethers, are also especially preferred. The nonionic surfactants also include alkyl glycosides of the general formula $RO(G)_x$, in which R denotes a primary linear or methyl-branched aliphatic radical, in particular with the methyl branching in position 2, having 8 to 22 carbon atoms, preferably 12 to 18 carbon atoms, and G stands for a glycose unit with 5 or 6 carbon atoms, preferably glucose. The degree of oligomerization x, which indicates the distribution of monoglycosides and oligoglycosides, may be any number—which may also assume fractional values as a quantity to be determined by analysis—between 1 and 10; x is preferably 1.2 to 1.4. Also suitable are polyhydroxy fatty acid amides of formula (VI), in which $R^1CO$ stands for an aliphatic radical with 6 to 22 carbon atoms, $R^2$ stands for hydrogen, an alkyl or hydroxyalkyl radical with 1 to 4 carbon atoms, and [Z] stands for a linear or branched polyhydroxyalkyl radical with 3 to 10 carbon atoms and 3 to 10 hydroxyl groups:

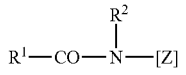

(VI)

The polyhydroxy fatty acid amides are known substances, which can usually be obtained by reductive amination of a reducing sugar with ammonia, an alkylamine or an alkanolamine and subsequent acylation with a fatty acid, a fatty acid alkyl ester or a fatty acid chloride. The group of polyhydroxy fatty acid amides also includes compounds of Formula (VII):

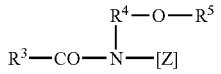

(VII)

in which $R^3$ stands for a linear or branched alkyl or alkenyl radical with 7 to 12 carbon atoms, $R^4$ stands for a linear, branched or cyclic alkylene radical or an arylene radical with 2 to 8 carbon atoms and $R^5$ stands for a linear, branched or cyclic alkyl radical or an aryl radical or an oxyalkyl radical with 1 to 8 carbon atoms, where $C_{1-4}$ alkyl or phenyl radicals are preferred, and [Z] stands for a linear polyhydroxyalkyl radical whose alkyl chain is substituted with at least two hydroxyl groups, or alkoxylated preferably ethoxylated or propoxylated derivatives of this radical. [Z] is preferably obtained by reductive amination of a sugar, e.g. glucose, fructose, maltose, lactose, galactose, mannose or xylose. The N-alkoxy- or N-aryloxy-substituted compounds may then be converted into the desired polyhydroxy fatty acid amides by reacting them with fatty acid methyl esters in the presence of an alkoxide as the catalyst. Another class of nonionic surfactants that are preferred for use either as the sole nonionic surfactant or in combination with other nonionic surfactants, in particular together with alkoxylated fatty alcohols and/or alkyl glycosides include alkoxylated, preferably ethoxylate or ethoxylated and propoxylated fatty acid alkyl esters, preferably with 1 to 4 carbon atoms in the alkyl chain, in particular fatty acid methyl esters. Nonionic surfactants of the amine oxide type, e.g., N-cocoalkyl-N,N-dimethylamine oxide and N-tallow alkyl-N,N-dihydroxyethylamine oxide and the fatty acid alkanolamides may also be suitable. The amount of these nonionic surfactants is preferably no more than that of the ethoxylated fatty alcohols, in particular no more than half thereof. So-called gemini surfactants may also be considered as additional surfactants. These are understood in general to include compound having two hydrophilic groups per molecule. These groups are usually separated from one another by so-called spacers. These spacers are usually a carbon chain which should be long enough so that the hydrophilic groups are a sufficient distance away so that they can act independently of one another. Such surfactants are characterized in general by an unusually low critical micelle concentration and the ability to greatly reduce the surface tension of water. In exceptional cases, the term gemini surfactant is understood to include not only such "dimeric" surfactants but also "trimeric" surfactants accordingly. Suitable gemini surfactants include, for example, sulfated hydroxy mixed ethers or dimeric alcohol bis-sulfates and ether sulfates and trimeric alcohol tris-sulfates and ether sulfates. End-group-capped dimeric and trimeric mixed ethers are characterized in particular by their bifunctionality and/or multifunctionality. Said end-group-capped surfactants have good wetting properties and are low-sudsing, so they are suitable in particular for use in machine washing and cleaning processes. However, gemini polyhydroxy fatty acid amides or polypolyhydroxy fatty acid amides may also be used. Sulfuric acid monoesters of linear or branched $C_7$-$C_{21}$ alcohols ethoxylated with 1 to 6 mol ethylene oxide are also suitable, such as 2-methyl-branched $C_9$-$C_{11}$ alcohols with an average of 3.5 mol ethylene oxide (EO) or $C_{12}$-$C_{18}$ fatty alcohols with 1 to 4 EO. The preferred anionic surfactants also include the salts of alkylsulfosuccinic acid, which are also known as sulfosuccinates or sulfosuccinic acid esters, and the monoesters and/or diesters of sulfosuccinic acid with alcohols, preferably fatty alcohols and in particular ethoxylated fatty alcohols. Preferred sulfosuccinates contain $C_8$ to $C_{18}$ fatty alcohol radicals or mixtures thereof. Especially preferred sulfosuccinates contain a fatty alcohol radical derived from ethoxylated fatty alcohols, which are nonionic surfactants when considered themselves. Especially preferred again are the sulfosuccinates whose fatty alcohol radicals are derived from ethoxylated fatty alcohols with a narrow range homolog distribution. It is likewise possible to use alk(en)ylsuccinic acid with preferably 8 to 18 carbon atoms in the alk(en)yl chain or the salts thereof. Additional anionic surfactants that may be considered include fatty acid derivatives of amino acids, e.g. N-methyltaurine (taurides) and/or N-methylglycine (sarcosides). The sarcosides and/or sarcosinates, especially sarcosinates of higher and optionally mono- or polyunsaturated fatty acids such as oleyl sarcosinate are especially preferred here. In particular soaps may be considered as additional anionic surfactants. Suitable in particular are the saturated fatty acid soaps such as the salts of lauric acid, myristic acid, palmitic acid, stearic acid, hydrogenated erucaic acid and behenic acid as well as in particular soap mixtures derived from natural fatty acids, e.g. coconut, palm kernel or tallow fatty acids. The known alkenylsuccinic acid salts may also be used together with these soaps or as a substitute for soaps.

The anionic surfactants, including the soaps, may be used in the form of their sodium, potassium or ammonium salts and as soluble salts of organic bases such as mono-, di- or triethanolamine. The anionic surfactants are preferably in the form of their sodium or potassium salts, in particular in the form of the sodium salts.

Surfactants are present in the inventive detergents in quantitative amounts of preferably 5 wt % to 50 wt %, in particular from 8 wt % to 30 wt %.

An inventive agent preferably contains at least one water-soluble and/or water-insoluble organic and/or inorganic builder. The water-soluble organic builder substances include polycarboxylic acids, in particular citric acid and sugar acids, monomeric and polymeric aminopolycarboxylic acids, in particular methyl glycine diacetic acid, nitrilotriacetic acid and ethylenediamine-tetraacetic acid as well as polyaspartic acid, polyphosphonic acids in particular aminotris(methylenephosphonic acid), ethylenediaminetetrakis(methylenephosphonic acid) and 1-hydroxyethane-1,1-diphosphonic acid, polymeric hydroxy compounds such as dextrin and polymeric polycarboxylic acids, in particular the polycarboxylates accessible by oxidation of polysaccharides and/or dextrins, polymeric acrylic acids, methacrylic acids, maleic acids and copolymers of these, which may also contain small amounts of polymerizable substances without the carboxylic acid functionality polymerized into them. The relative molecular weight of the homopolymers of unsaturated carboxylic acids is generally between 3000 and 200,000, while that of the copolymers is between 2000 and 200,000, preferably 30,000 to 120,000, each based on the free acid. An especially preferred acrylic acid-maleic acid copolymer has a relative molecular weight of 30,000 to 100,000. Commercial products include, for example, Sokalan® CP 5, CP 10 and PA 30 from the company BASF. Suitable compounds of this class, although they are less preferred, include the copolymers of acrylic acid or methacrylic acid with vinyl ethers such as vinyl methyl ethers, vinyl esters, ethylene, propylene and styrene, in which the acid is present in an amount of at least 50 wt %. The water-soluble organic builder substances may also be terpolymers which contain as monomers two unsaturated acids and/or their salts and as a third monomer vinyl alcohol and/or an esterified vinyl alcohol or a carbohydrate. The first acid monomer and/or its salt is derived from a monoethylenically unsaturated $C_3$-$C_8$ carboxylic acid and preferably from a $C_3$-$C_4$ monocarboxylic acid, in particular (meth)acrylic acid. The second acidic monomer and/or its salt may be a derivative of a $C_4$-$C_8$ dicarboxylic acid, whereby maleic acid is especially preferred, and/or a derivative of an allylsulfonic acid which is substituted in position 2 with an alkyl or aryl radical. Such polymers in general have a relative molecular weight between 1000 and 200,000. Other preferred copolymers include those having preferably acrolein and acrylic acid/acrylic acid salts and/or vinyl acetate as monomers. The organic builder substances may be used in the form of aqueous solutions, preferably in the form of 30 wt % to 50 wt % aqueous solutions, in particular to produce liquid agents. All the acids mentioned are usually used in the form of their water-soluble salts, in particular their alkali salts.

Such organic builder substances may, if desired, if present in amounts of up to 40 wt %, in particular up to 25 wt % and preferably from 1 wt % to 8 wt %. Quantities close to the aforementioned upper limit are preferably used in paste or liquid agents, in particular in aqueous inventive agents.

The water-soluble inorganic builder materials that may be considered include in particular the alkali silicates, alkali carbonates and alkali phosphates which may be present in the form of their alkaline, neutral or acidic sodium or potassium salts. Examples include trisodium phosphate, tetrasodium diphosphate, disodium dihydrogen diphosphate, pentasodium triphosphate, so-called sodium hexametaphosphate, oligomeric trisodium phosphate with degrees of oligomerization from 5 to 1000, in particular 5 to 50, as well as the corresponding potassium salts and/or mixtures of sodium and potassium salts. In particular crystalline or amorphous alkali aluminosilicates in amounts of up to 50 wt %, preferably no more than 40 wt %, and in liquid agents in particular from 1 wt % to 5 wt % may be used as the water-insoluble, water-dispersible inorganic builder materials. Of these, the crystalline sodium aluminosilicates of detergent quality, in particular zeolites A, P and optionally X, are preferred, either alone or in mixtures, e.g. in the form of a cocrystallizates of the zeolites A and X (Vegobond® AX, a commercial product of Condea Augusta S.p.A.). Amounts close to the aforementioned upper limit are preferably used in solid particulate agents. Suitable aluminosilicates have in particular no particles with a particle size of more than 30 μm and preferably consists of at least 80 wt % of particles with a size of less than 10 μm. Their calcium binding capacity, which can be determined according to the specifications of German Patent DE 24 12 837, is usually in the range of 100 to 200 mg CaO per gram.

Suitable substitutes and/or partial substitutes for the aforementioned aluminosilicate are crystalline alkali silicates which may be used alone or in mixture with amorphous silicates. The alkali silicates usable as builders in the inventive agents preferably have a molar ratio of alkali oxide to $SiO_2$ of less than 0.95, in particular from 1:1.1 to 1:12 and may be amorphous or crystalline. Preferred alkali silicates are the sodium silicates in particular the amorphous sodium silicates with a molar ratio $Na_2O:SiO_2$ of 1:2 to 1:2.8. The crystalline silicates used, which may be present alone or in mixture with amorphous silicates, are preferably crystalline phyllosilicates of the general formula $Na_2Si_xO_{2x+1}.yH_2O$, in which x, the so-called modulus, has a value of 1.9 to 22, in particular 1.9 to 4, and y is a number from 0 to 33 and preferred values for x are 2, 3 or 4. Preferred crystalline phyllosilicates are those in which x in the aforementioned general formula assumes values of 2 or 3. In particular both β- and δ-sodium disilicates ($Na_2Si_2O_5.yH_2O$) are preferred.

Practically anhydrous crystalline alkali silicates of the general formula given above in which x denotes a number from 1.9 to 2.1 and which are synthesized from amorphous alkali silicates may be used in the inventive agents. In another preferred embodiment of inventive agents, a crystalline sodium phyllosilicate with a modulus of 2 to 3 which can be produced from sand and soda, is used. Crystalline sodium silicates with a modulus in the range of 1.9 to 3.5 are used in another preferred embodiment of inventive agents. Crystalline sheet silicates of the aforementioned formula (I) are distributed by the company Clariant GmbH under the brand name Na-SKS, e.g. Na-SKS-1 ($Na_2Si_{22}O_{45}.xH_2O$, kenyaite), Na-SKS-2 ($Na_2Si_{14}O_{29}.xH_2O$, magadiite), Na-SKS-3 ($Na_2Si_8O_{17}.xH_2O$) or Na-SKS-4 ($Na_2Si_4O_9.xH_2O$, makatite). Of these, especially Na-SKS-5 ($\alpha$-$Na_2Si_2O_5$), Na-SKS-7 ($\beta$-$Na_2Si_2O_5$, natrosilite), Na-SKS-9 ($NaHSi_2O_5.3H_2O$), Na-SKS-10 ($NaHSi_2O_5.3H_2O$), kanemite), Na-SKS-11 (t-$Na_2Si_2O_5$) and Na-SKS-13 ($NaHSi_2O_5$), but in particular Na-SKS-6 ($\delta$-$Na_2Si_2O_5$) are especially suitable. In a preferred embodiment of the inventive agents, a granular compound of crystalline phyllosilicate and citrate, crystalline phyllosilicate and the aforementioned (co)polymeric polycarboxylic acid or from alkali silicate and alkali carbonate is used such as that commercially available under the brand name Nabion® 15, for example.

Builder substances are preferably present in the inventive agents in amounts of up to 75 wt %, in particular 5 wt % to 50 wt %.

In particular organic peracids and/or peracid salts of organic acids such as phthalimidopercaproic acid, perbenzoic acid or salts of diperdodecanedioic acid, hydrogen peroxide and inorganic salts that release hydrogen peroxide under the washing conditions, including perborate, percarbonate, persilicate and/or persulfate as well as caroate may be considered as suitable perhydrogen compounds for use in the inventive agents. If solid perhydrogen compounds are to be used, they may be used in the form of powders or granules which may in principle also be sheathed in a known manner. If an inventive agent contains perhydrogen compounds they are preferably present in amounts up to 50 wt %, in particular from 5 wt % to 30 wt %. It may be expedient to small amounts of known bleaching agent stabilizers such as phosphonates, borates and/or metaborates and metasilicates as well as magnesium salts such as magnesium sulfate.

The bleach activators used may be compounds which form aliphatic peroxocarboxylic acids preferably with 1 to 10 carbon atoms, in particular 2 to 4 carbon atoms and/or optionally substituted perbenzoic acid under perhydrolysis conditions. Suitable substances having O- and/or N-acyl groups of the aforementioned number of carbon atoms and/or optionally substituted benzoyl groups are suitable. Preferred examples are polyacylated alkylenediamines in particular tetraacetylethylenediamine (TAED), acylated triazine derivatives in particular 1,5-diacetyl-2,4-dioxohexahydro-1,3,5-triazine (DADHT), acylated glycolurils, in particular tetraacetylglycoluril (TAGU), N-acylimides in particular N-nonanoylsuccinimide (NOSI), acylated phenol sulfonates in particular n-nonanoyl- or isononanoyloxybenzenesulfonate (n- and/or iso-NOBS), carboxylic acid anhydrides in particular phthalic acid anhydride, acylated polyvalent alcohols in particular triacetin, ethylene glycol diacetate, 2,5-diacetoxy-2,5-dihydrofuran and enol esters as well as acetylated sorbitol and mannitol and/or their mixtures (SORMAN) that have been described, acylated sugar derivatives in particular pentaacetylglucose (PAG), pentaacetylfructose, tetraacetylxylose and octaacetyllactose as well as acetylated, optionally N-alkylated glucamine and gluconolactone and/or N-acylated lactams, e.g. N-benzoylcaprolactam. The hydrophilically substituted acylacetals and the acyllactams are also preferred for use here. Combinations of conventional bleach activators may also be used. Such bleach activators may be used in the usual quantity, preferably in amounts of 0.5 wt % to 10 wt %, in particular 1 wt % to 8 wt %, based on the total agent, especially in the presence of the aforementioned bleaching agents that supply hydrogen peroxide, but they are preferably omitted entirely when using percarboxylic acid as the only bleaching agent.

In addition to or instead of the conventional bleach activators, sulfone-imines and/or bleach-potentiating transition metal salts and/or transition metal chelates may also be present as so-called bleach catalysts.

Enzymes usable in the agents include those from the class of amylases, proteases, lipases, cutinases, pullulanases, hemicellulases, cellulases, oxidases, laccases and peroxidases and their mixtures. Especially suitable are the enzymatic active ingredients obtained from yeasts or bacteria, such as *Bacillus subtilis, Bacillus licheniformis, Bacillus lentus, Streptomyces griseus, Humicola lanuginosa, Humicola insolens, Pseudomonas pseudoalcaligenes, Pseudomonas cepacia* or *Coprinus cinereus*. The enzymes may be adsorbed onto carrier materials and/or embedded in sheathing substances to protect them from premature inactivation. They are preferably present in the inventive detergents or cleaning in amounts of up to 5 wt %, in particular from 0.2 wt % to 4 wt %. If the inventive agent contains protease, it preferably has a proteolytic activity in the range of approx. 100 PU/g to approx. 10,000 PU/g, in particular 300 PU/g to 8000 PU/g. If several enzymes are to be used in the inventive agents, this may be accomplished by incorporating the two or more separated enzymes or enzymes prepared separately in a known way or by two or more enzymes present jointly in granules.

In addition to water, the organic solvents usable in the inventive agents, in particular when they are present in liquid or paste form include alcohols with 1 to 4 carbon atoms, in particular methanol, ethanol, isopropanol and tert-butanol, diols with 2 to 4 carbon atoms, in particular ethylene glycol and propylene glycol as well as mixtures thereof and the ethers that can be derived from these classes of compounds. Such water-miscible solvents are preferably present in the inventive agents in amounts of no more than 30 wt %, in particular from 6 wt % to 20 wt %.

To adjust the desired pH, which is not automatically established by mixing the other components, the inventive agents may contain acids that are compatible with the system and are environmentally acceptable, in particular citric acid, acetic acid, tartaric acid, malic acid, lactic acid, glycolic acid, succinic acid, glutaric acid and/or adipic acid but also mineral acids in particular sulfuric acid or bases, in particular ammonium hydroxides or alkali hydroxides. Such pH regulators are preferably present in the inventive agents in amounts of no more than 20 wt %, in particular from 1.2 wt % to 17 wt %.

Anti-grey compounds have the function of keeping the dirt that has been released from the textile fibers suspended in the wash solution. Water-soluble colloids, usually of an organic nature, are suitable for this purpose, e.g. starch, glue, gelatin, salts of ether carboxylic acids or ether sulfonic acids of starch or cellulose or salts of acidic sulfuric acid esters of cellulose or of starch. Water-soluble polyamides containing acid groups are also suitable for this purpose. In addition, starch derivatives other than those listed above may also be used, e.g., aldehyde starches. Cellulose ethers such as carboxymethyl cellulose (sodium salt), methyl cellulose, hydroxyalkyl cellulose and mixed ethers such as methylhydroxyethyl cellulose, methylhydroxypropyl cellulose, methylcarboxymethyl cellulose and mixtures thereof, e.g., in amount of 0.1 to 5 wt %, based on the agents, are preferred.

Inventive textile detergents may contain, for example, derivatives of diaminostilbenedisulfonic acid and/or their alkali metal salts as optical brighteners, although they are preferably free of optical brighteners for use as detergents for colored fabrics. For example, salts of 4,4'-bis(2-anilino-4-morpholino-1,3,5-triazinyl-6-amino)stilbene-2,2'-disulfonic acid or compounds having a similar structure, which contain a diethanolamino group, a methylamino group, an anilino group or a 2-methoxyethylamino group instead of the morpholino group are also suitable. In addition, brighteners of the substituted diphenylstyryl type may also be present, e.g. the alkali salts of 4,4'-bis(2-sulfostyryl)diphenyl, 4,4'-bis(4-chloro-3-sulfostyryl)diphenyl or 4-(4-chlorostyryl)-4'-(2-sulfostyryl)diphenyl. Mixtures of the aforementioned optical brighteners may also be used.

For use in machine washing methods in particular, it may be advantageous to add conventional foam inhibitors to the agents. Suitable foam inhibitors include, for example, soaps of natural or synthetic origin which contain a large amount of $C_{18}$-$C_{24}$ fatty acids. Suitable nonsurfactant foam inhibitors include, for example, organopolysiloxanes and their mixtures with microfine, optionally silanized silicic acid and paraffins, waxes, microcrystalline waxes and mixtures thereof with silanized silicic acid or bis-fatty acid alkylene-diamides. Mixtures of various foam inhibitors may also be used to advantage, e.g., those of silicones, paraffins or waxes.

The foam inhibitors, in particular foam inhibitors containing silicone and/or paraffin, are preferably bound to a granular, water-soluble and/or water-dispersible carrier substance. Mixtures of paraffins and bistearyl-ethylenediamide are preferred in particular.

Synthesis of the inventive solid agents does not pose any problems and can be performed by known methods, e.g., by spray drying or granulation, in which enzymes and possibly other thermally sensitive ingredients such as bleaching agents are optionally added separately at a later time. To synthesize the inventive agents with an elevated bulk density, in particular the range of 650 g/L to 950 g/L, a method involving an extrusion step is preferred.

To manufacture inventive agents in tablet form, which may consist of a single layer in one or more phases, one or more colors and in particular may consist of one layer or multiple layers, in particular two layers, the procedure followed is preferably to mix all the ingredients together in a mixer, optionally in one layer each, and then to press the mixture using traditional tablet presses, e.g. eccentric presses or rotary presses, using pressing forces in the range from approx. 50 to 100 kN, preferably 60 to 70 kN. In particular with multilayer tablets, it may be advantageous if at least one layer is prepressed. This is preferably performed at pressing forces between 5 and 20 kN, in particular at 10 to 15 kN, yielding break-resistant tablets, which nevertheless dissolve rapidly enough under use conditions and have breaking strengths and bending strengths of normally 100 to 200 N, but preferably more than 150 N. A tablet produced in this way preferably has a weight of 10 g to 50 g, in particular from 15 g to 40 g. The tablets may be of any shape, namely round, oval or polygonal, but intermediate shapes are also possible. The corners and edges are advantageously rounded. Round tablets preferably have a diameter of 30 mm to 40 mm. The size of polygonal or cuboid tablets, which are preferably introduced into dishwashing machines, for example, through the metering device, depends on the geometry and volume of this metering device. For example, preferred embodiments have a base area of (20 to 30 mm)×(34 to 40 mm), in particular a base area of 26×36 mm or 24×38 mm.

Liquid and/or pasty inventive agents in the form of solutions containing conventional solvents are usually prepared by simple mixing of the ingredients, which may be added to automatic mixer in bulk or as a solution.

EXAMPLES

Example 1

Dye Transfer Inhibition

The compositions of an inventive detergent or cleaning agent E1 as well as those of a comparative example V1 are given in the following table:

TABLE 1

| | V1 | E1 |
|---|---|---|
| $C_{12-18}$ fatty alcohol with 7 EO | 10 | 10 |
| $C_{12-14}$ alkyl polyglycoside | 3 | 3 |
| Polyacrylate thickener | 0.2 | 0.2 |
| Ethanol | 3 | 3 |
| Citric acid | 5 | 5 |
| Phosphonic acid | 0.4 | 0.4 |
| Active ingredient | – | 0.4 |
| PVP/PVI | 0.1 | – |
| Sodium hydroxide solution (50%) | 3.2 | 3.2 |
| Propylene glycol | 9 | 9 |
| Boric acid | 1 | 1 |
| Silicone foam suppressant | 0.003 | 0.003 |
| Perfume | 1.5 | 1.5 |
| Enzyme*, dye | + | + |
| Water | To 100 | To 100 |

*Mixture of cellulase, amylase and protease

All detergent or cleaning agent compositions were stable and had no precipitation.

To determine the dye transfer inhibiting properties of the individual detergents or cleaning agents, a staining scale rating (SSR), which is based on ISO 105-A04, was performed. To do so, two white fabrics (so-called adjacent fabrics) were washed with a colored fabric using one of the detergent or cleaning agent formulations given above in a Linitester (from Atlas) at 60° C., then rinsed with water and dried hanging at room temperature. Next the degree of discoloration of the two adjacent fabrics was determined by spectro-photometry.

The degree of discoloration was then given in values from 1 (severe discoloration) to 5 (no discoloration).

It became clear from the SSR that the inventive agent has better dye transfer inhibiting properties with respect to multiple textile dyes than the comparative recipe.

Example 2

Color Retention

The agents listed in Example 1 were tested on the dyed textiles under conditions that otherwise correspond to those of Example 1.

Washing Conditions

Boiling/colored washing program 60° C., Miele W 985

Number of wash/dry cycles 5

Water hardness 16° dH

Dosing 75 g

Test Textiles

Colored textiles

Red textile

Yellow textile

Black textile

Measurement and Analysis of Results

The color changes in the textiles are measured with a Spectraflash instrument (with UV without glare) and the dL, da, db and dE values are converted into GSC values; scale 1-5 (1=poor, 5=no change).

The use of the inventive agent E1 led to a number that was higher by at least one than did the use of agent VI in a comparison of the averages from all five test textiles.

What is claimed is:

1. A method of preventing the transfer of a textile dye from a dyed textile to an undyed textile or from a first dyed textile to a second dyed textile having a different color than the first dyed textile when washed together in an aqueous solution comprising a surfactant, said method comprising providing the aqueous solution with at least one polycarbonate-polyorganosiloxane compound containing at least one structural element of Formula (I):

$$—Y-A-(C{=}O)-A- \quad (I)$$

where each A is O,

Y is a divalent or polyvalent, linear, cyclic or branched, saturated, unsaturated or aromatic, substituted or unsubstituted hydrocarbon radical with up to 1000 carbon atoms, where the carbon atoms of a polyorganosiloxane unit that is optionally also contained are not counted, which may contain one or more groups selected from —O—, —(CO)—, —NH—, —$NR^2$—, —($N^+R^2R^3$)— or a polyorganosiloxane unit with 2 to 1000 silicon atoms, $R^1$ is hydrogen or a linear, cyclic or branched, saturated, unsaturated or aromatic hydrocarbon radical with up to 40 carbon atoms, which may contain one or more groups selected from —O—, —(CO)—, —NH— or —$NR^2$—, $R^2$ is a linear, cyclic or branched, saturated, unsaturated or aromatic hydrocarbon radical with up to 40 carbon atoms, which may contain one or more groups selected from —O—, —(CO)— or —NH—, $R^3$ is a linear, cyclic or branched, saturated, unsaturated or aromatic hydrocarbon radical with up to 100 carbon atoms, which may contain one or more groups selected from —O—, —(CO)— or —NH— or is a divalent radical which forms a cyclic structure within the radical Y, or one or both radicals A vicinal to Y together with the radical Y between them may form a heterocyclic radical containing nitrogen, and in the entire compound, not all the radicals Y and/or $R^1$ and/or $R^2$ and/or $R^3$ indicated in Formula (I) must be the same, with the provision that at least one of the radicals Y in the entire compound is a polyorganosiloxane unit with 2 to 1000 silicon atoms or an acid addition compound and/or salt thereof.

2. The method according to claim 1, wherein the polyorganosiloxane unit present in the polycarbonate-polyorganosiloxane compound has a structure —$(SiR^4{}_2O)_p$—$(SiR^4{}_2)$—, where $R^4$ is a linear, cyclic or branched, saturated, unsaturated or aromatic hydrocarbon radical with up to 20 carbon atoms, and p=1 to 999.

3. The method according to claim 1, wherein the polycarbonate-polyorganosiloxane compound contains at least two polyorganosiloxane units.

4. The method according to claim 1, wherein at least one of the Y units according to the structural element of Formula (I) in the polycarbonate-polyorganosiloxane compound has a group —$NR^2$— and/or at least one of the Y units according to the structural element of Formula (I) has a group —($N^+R^2R^3$)—.

5. The method according to claim 1, wherein oligoethoxy and/or oligopropoxy groups are present in at least one of the units Y, $R^1$, $R^2$ and/or $R^3$ according to the structural element of Formula (I), the oligoethoxy and/or oligopropoxy groups having degrees of oligomerization in the range of 2 to 60.

6. The method according to claim 1, wherein oligoethylene-imine groups, whose degrees of oligomerization are in the range of 10 to 150,000, are present in at least one of the units Y, $R^1$, $R^2$ and/or $R^3$ according to the structural element of Formula (I).

7. The method according to claim 1, wherein the aqueous solution additionally comprises at least one polymer of vinylpyrrolidone, vinylimidazole, vinylpyridine N-oxide or a copolymer thereof.

8. The method according to claim 1, wherein the aqueous solution additionally comprises at least one builder.

* * * * *